US007827714B2

(12) United States Patent
Howard et al.

(10) Patent No.: US 7,827,714 B2
(45) Date of Patent: Nov. 9, 2010

(54) POLE MOUNTED ILLUMINATED SIGN

(75) Inventors: Carol A. Howard, Oxford, CT (US); Daniel W. Marconi, Trumbull, CT (US)

(73) Assignee: Hubbell Incorporated, Shelton, CT (US)

( * ) Notice: Subject to any disclaimer, the term of this patent is extended or adjusted under 35 U.S.C. 154(b) by 1116 days.

(21) Appl. No.: 11/413,214

(22) Filed: Apr. 28, 2006

(65) Prior Publication Data

US 2007/0253208 A1 Nov. 1, 2007

(51) Int. Cl.
*G09F 13/04* (2006.01)

(52) U.S. Cl. ..... 40/572; 40/575; 174/493; 362/367; 362/368; 362/431; 362/812

(58) Field of Classification Search ..... 40/575, 40/572, 607.03; 174/493; 362/367, 368, 362/431, 812; 248/216.1, 217.3, 218.4
See application file for complete search history.

(56) References Cited

U.S. PATENT DOCUMENTS 1,034,211 A 7/1912 DePalma
2,456,179 A 12/1948 Finer
2,850,823 A 9/1958 Sauer
3,167,874 A * 2/1965 Pogue ..... 40/607.03
3,696,242 A 10/1972 Patry
3,777,138 A * 12/1973 Metzler ..... 362/235
4,166,601 A 9/1979 Kato
4,225,909 A * 9/1980 Scholz et al. ..... 362/367
4,264,945 A 4/1981 Ullman
4,719,548 A * 1/1988 Orosz ..... 362/309
4,787,019 A 11/1988 van den Broeke
4,847,741 A 7/1989 Boettinger
D331,198 S 11/1992 Nickerson
5,315,495 A * 5/1994 Buser ..... 362/373

(Continued)

FOREIGN PATENT DOCUMENTS

EP 426238 A1 5/1991

(Continued)

OTHER PUBLICATIONS

Bertelson, Michael A., Third Party Submission to the United States Patent and Trademark Office, Dec. 21, 2007, 4 pp.

(Continued)

*Primary Examiner*—Gary C Hoge
(74) *Attorney, Agent, or Firm*—Jenae C. Gureff; Mark S. Bicks; Alfred N. Goodman

(57) ABSTRACT

A lighting unit adapted to be mounted to a vertical member, preferably a pole for use at a checkout counter in a retail service location. The lighting unit includes a substantially polygonal housing secured to the pole. The housing typically includes at least three sides, a top, and a base; the top may have slots to promote ventilation. An opening is formed in the first side of the housing and defines a receiving location for the pole, situated between the top and base of the housing. A clamp plate is releasably engageable with the first side of the housing spans the opening adjacent to the pole, and releasably engages the pole to provide for easy vertical adjustment of the housing relative to the pole. Each flange can advantageously include at least one set of teeth for enhancing the gripping strength of the clamp plates and penetrating the vertical member.

35 Claims, 5 Drawing Sheets

U.S. PATENT DOCUMENTS

| | | | | |
|---|---|---|---|---|
| 5,803,590 | A | 9/1998 | Wedell | |
| D403,360 | S | 12/1998 | Cobb et al. | |
| D412,015 | S | 7/1999 | Greenfield | |
| 6,050,012 | A | 4/2000 | Greenfield | |
| 6,098,326 | A * | 8/2000 | Campbell, III | 40/575 |
| 6,450,657 | B1 | 9/2002 | Testa et al. | |
| D468,472 | S | 1/2003 | Mullally et al. | |
| D471,241 | S | 3/2003 | Spiller | |
| 6,682,204 | B2 * | 1/2004 | Mullally et al. | 362/249 |
| 2004/0134110 | A1 * | 7/2004 | Konny | 40/607.03 |

OTHER PUBLICATIONS

D&P Custom Lights & Products Inc. website excerpts, www.dandpcustomlights.com, date unknown, 3 pp.

Moon International website excerpts, www.mooninternational.com, date unknown, 381 pp.

* cited by examiner

POLE MOUNTED ILLUMINATED SIGN

FIELD OF THE INVENTION

The present invention relates to a pole mounted illuminated sign, especially for a commercial retail establishment. More particularly, the present invention relates to an illuminated sign having a housing comprising at least three sides that can receive labeled plaques identifying the housing. The housing further comprises a top for ventilation and a base for support. Still more particularly, the housing is mounted to a vertical pole and an electrical wiring system that provides electricity from the vertical pole to illuminate a lamp inside the housing. A clamp plate is releasably engaged with the side closest to the vertical pole to provide access to the electrical wiring system inside the housing and to allow easy vertical adjustment of the housing relative to the pole.

BACKGROUND OF THE INVENTION

Many commercial establishments use light fixtures mounted to a power pole since the pole provides both communication and power wiring, and a convenient place for supporting the light fixture. For example, stores with check out registers require a power pole for supplying the communication and power wiring to the register as well as a register light to indicate when the register is open, closed, or assistance is required.

However, conventional register lights can be difficult to mount directly on the power pole, particularly after the power pole has been installed, and difficult to vertically adjust as desired. For example, some conventional register lights must be disassembled then reassembled on the power pole, thereby requiring many steps to mount the register light. This can also result in a less aesthetically pleasing light due to the appearance of multiple parts assembled together. Also, several additional parts are often required to mount the register light.

Conventional register lights are often difficult to manufacture, expensive to make, and difficult to view from certain angles in a retail establishment.

Examples of conventional register lights and light fixtures include U.S. Pat. No. 6,682,204 to Mullally et al.; U.S. Pat. No. 6,265,984 to Molinaroli; U.S. Pat. No. 5,315,495 to Buser; U.S. Pat. No. 4,264,945 to Ullman; U.S. Pat. No. 4,225,909 to Scholz et al.; the subject matter of each of which is herein incorporated.

SUMMARY OF THE INVENTION

Accordingly, an object of the present invention is to provide a polygonal lighting unit that is easily mounted and adjusted on a vertical support structure, such as a pole or a multi-outlet assembly.

Another object of the present invention is to provide a lighting unit that, once mounted on a vertical support structure, can be used as a sign at a checkout counter of a retail service location.

Yet another object of the present invention is to provide a lighting unit that has a removable mounting segment for permitting access to electrical wiring within the lighting unit for a source of illumination, such as a light bulb or lamp.

A further object of the present invention is to provide a relatively easy to use, cheap to manufacture, and easy to install and adjust lighting unit that indicates to customers what lane is available for checking out.

Still another object of the invention is to provide a lighting unit that, once mounted on an elevated vertical member, such as a power pole, is visible from multiple locations throughout a retail establishment.

A further object of the invention is to provide a lighting unit that is attached to a vertical member with a clamp plate having a gripping means for adjustably securing the housing to the vertical member and can be used with vertical members of different depths.

The foregoing objects are basically attained by providing a lighting unit adapted to be mounted to a vertical member, the lighting unit including a substantially polygonal housing secured to the vertical member. The housing includes at least three sides, a top, and a base. An opening is formed in the first side of the housing and defines a receiving location for the vertical member between the top and base of the housing. A mounting segment, such as a clamp plate, is releasably engageable with the first side and is received in the opening adjacent to the vertical member. The mounting segment includes means for gripping the vertical member while also serving as an access cover for a wire chamber. The wire chamber is located within the receiving area for storing means for illuminating the housing, such as a light bulb or lamp.

Other objects, advantages and salient features of the invention will become apparent from the following detailed description, which, taken in conjunction with annexed drawings, discloses a preferred embodiment of the present invention.

BRIEF DESCRIPTION OF THE DRAWINGS

Referring to the drawings which form a part of this disclosure.

DETAILED DESCRIPTION OF THE INVENTION

Figure 1:
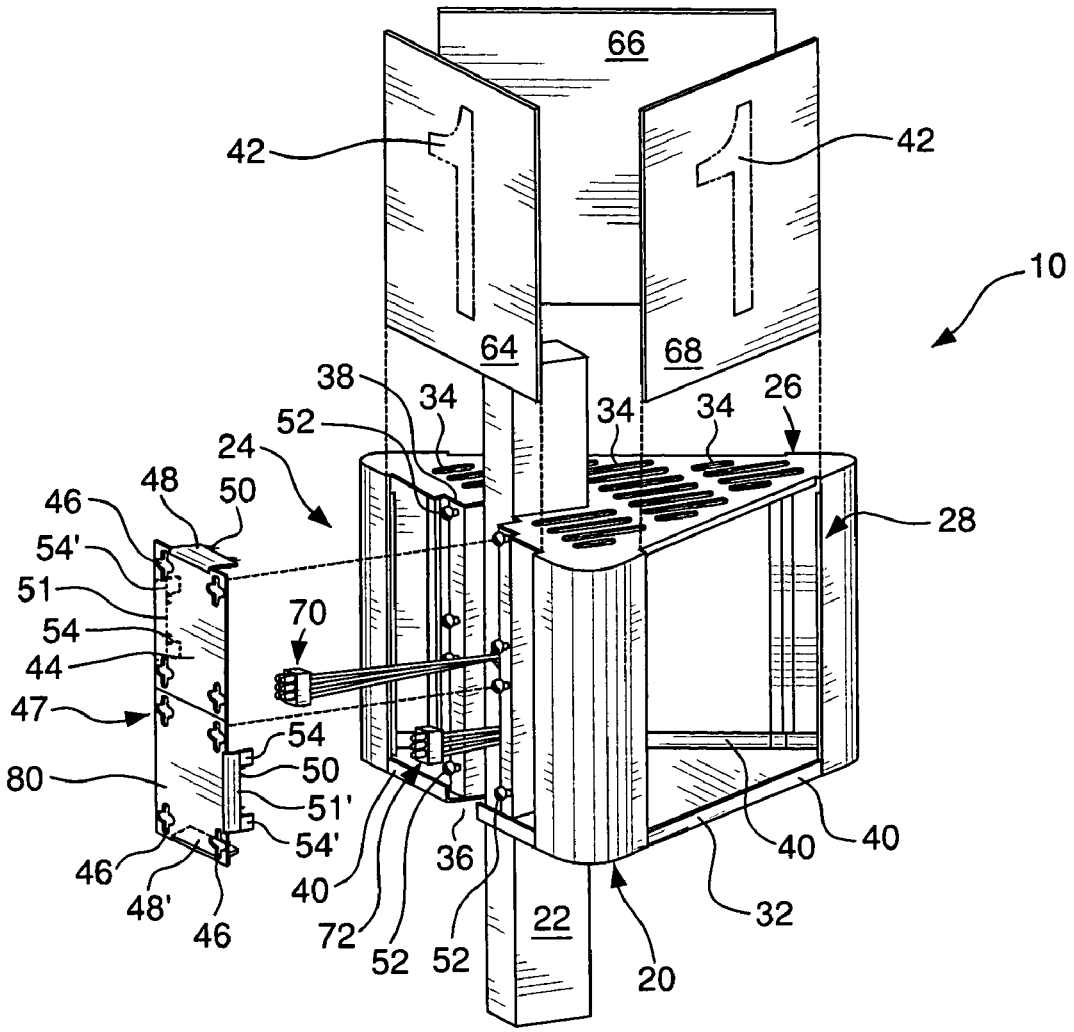
FIG. 1 is an exploded, rear, perspective view of the lighting unit, showing the clamp plate and plaques removed from the housing and showing wiring of the lighting unit.

As seen in FIGS. 1-7, the lighting unit 10 in accordance with an embodiment of the present invention generally includes a substantially polygonal housing 20 adapted to be adjustably mounted to a vertical member, a multi-outlet assembly, or a pole 22. The housing 20 is secured to the pole 22 and further includes at least a first side 24, a second side 26, and a third side 28 with at least one clamp plate 44 engaging the first side 24 and securing the housing 20 to the pole 22.

Figure 4:
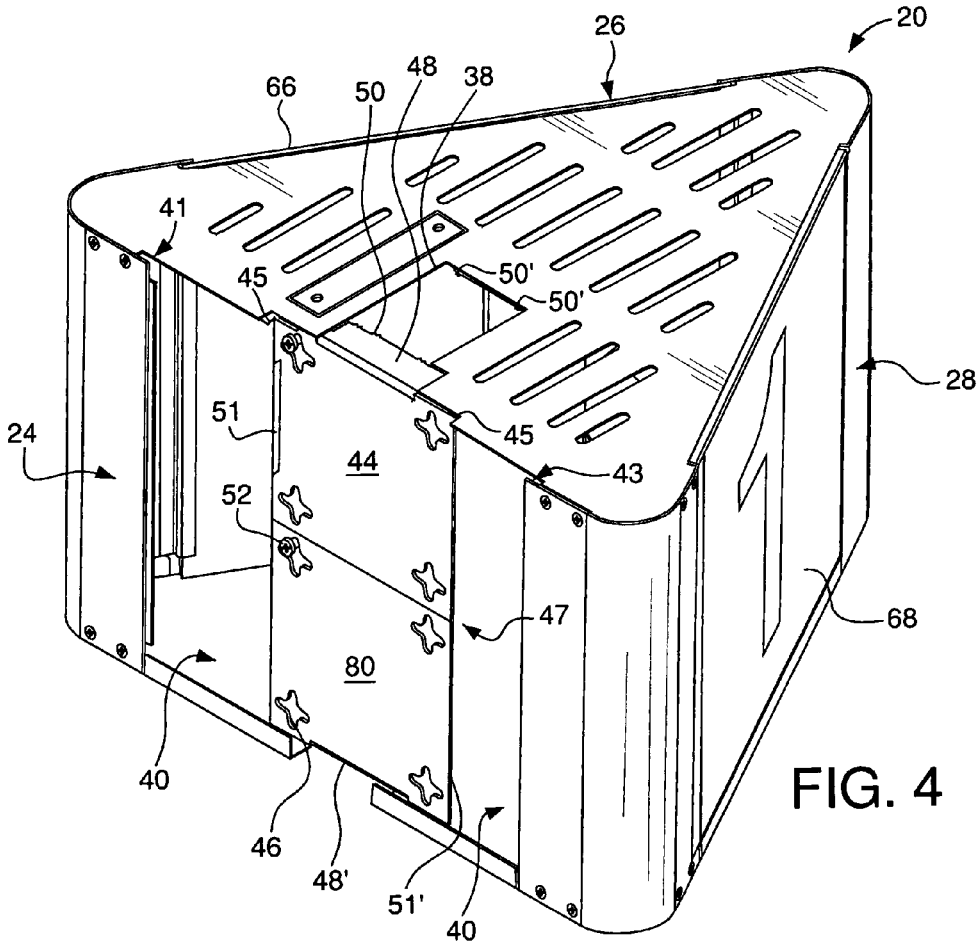
FIG. 4 is a rear perspective view of the first side of the lighting unit illustrated in FIG. 1, showing the clamp plate covering the wire chamber.
Figure 5:
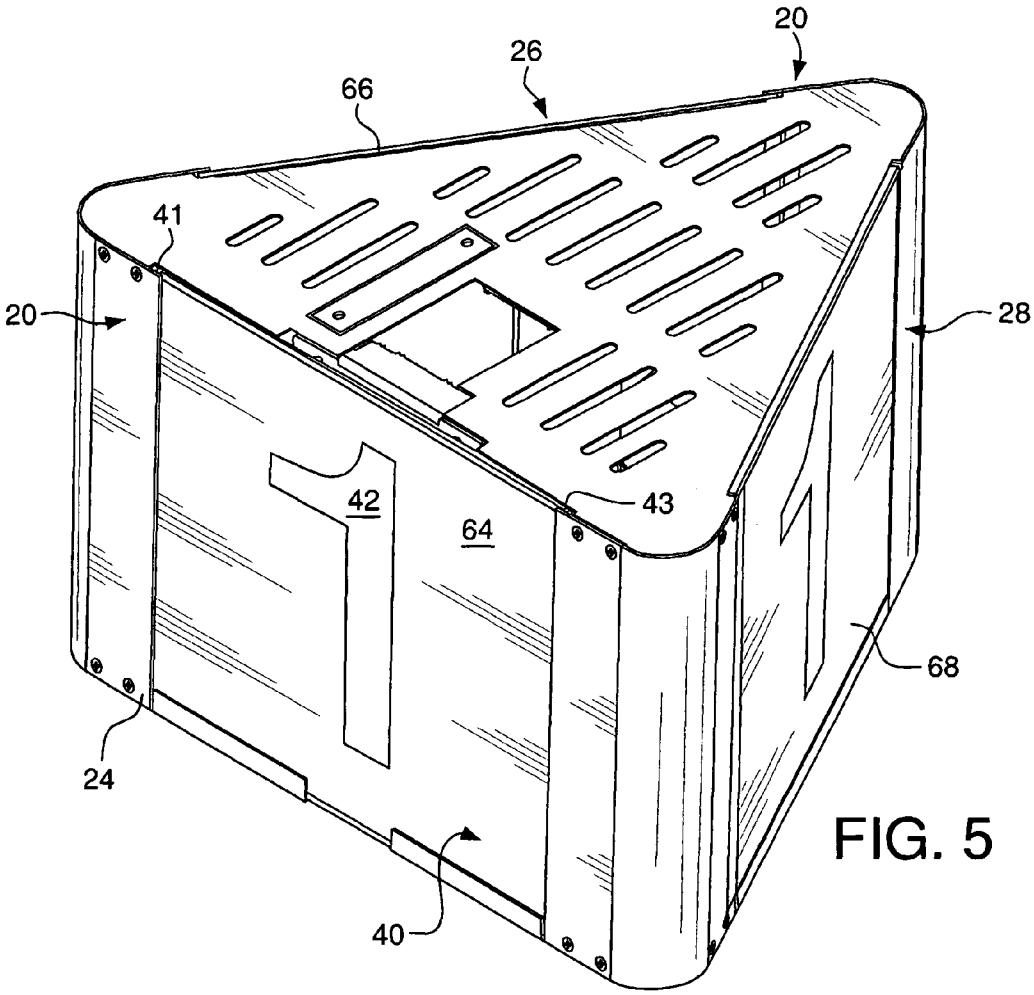
FIG. 5 is a side perspective view of the first side of the lighting unit illustrated in FIG. 1, showing the first plaque covering the wire chamber and the clamp plate illustrated in FIG. 4.

Housing 20 of lighting unit 10, as best seen in FIGS. 1 and 5, includes the first side 24, second side 26, and third side 28. Sides 24, 26, and 28 are situated evenly between a top 30 and a base 32 such that the lighting unit 10 can have the same appearance when viewed from a variety of locations. An opening or slot 36 is formed in the first side 24 of the housing 20 with at least one clamp plate 44 engaging the first side 24 and securing the housing 20 to the pole 22. The opening 36 defines a receiving location 38 for the pole 22 between the top 30 and the base 32 and extends into the housing substantially one-third the transverse depth of the housing. The main body 47 includes two clamp plates 44, 80 attached to each other at an edge. The clamp plates 44, 80 engage with two flanges (one on each side of opening 36) that have threaded holes to accept screws and are received in two recesses 45 in opening 36 in the first side 24 and are received in and span the opening 36 adjacent pole 22. They are to be releasably engaged by the first side 24. As seen in FIG. 4, the two substantially similar recesses 45 are vertically disposed outside a plane of the clamp plate 44 to securely receive clamp plates 44, 80. A wire chamber 56 (shown in FIG. 7) is supported by the pole 22 and located within the housing 20 for receiving electrical connections and means to illuminate the housing 20. The housing 20 attaches to the pole 22 for use as a sign for a checkout counter of a retail service location.

Figure 2:
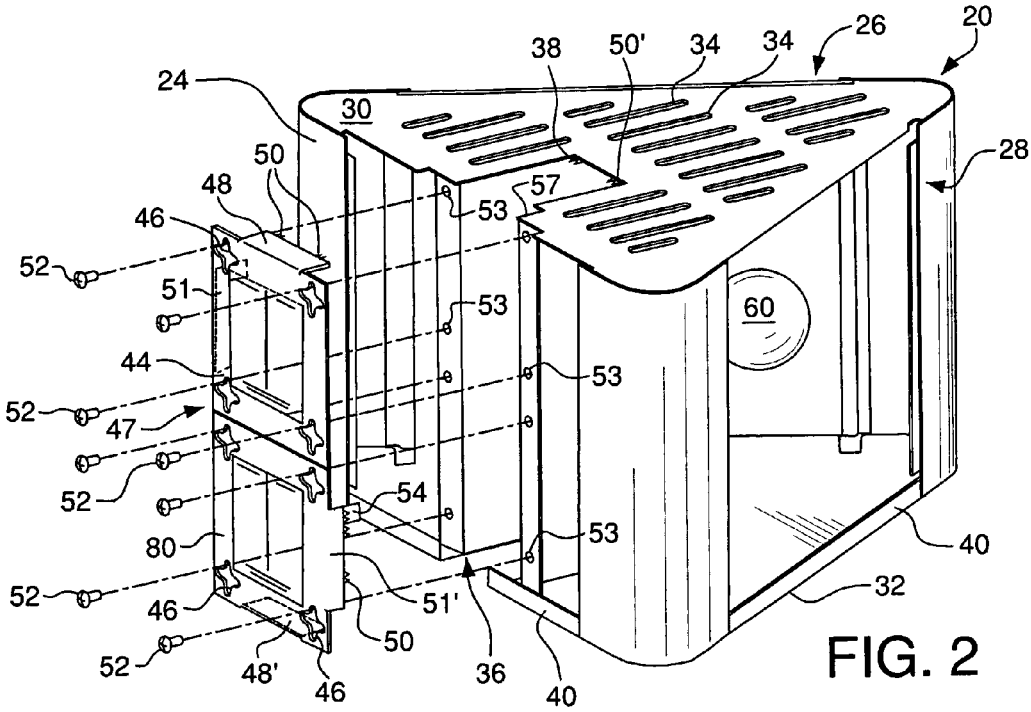
FIG. 2 is a rear perspective view of the housing illustrated in FIG. 1, showing the means for illuminating the housing of the lighting unit.
Figure 3:
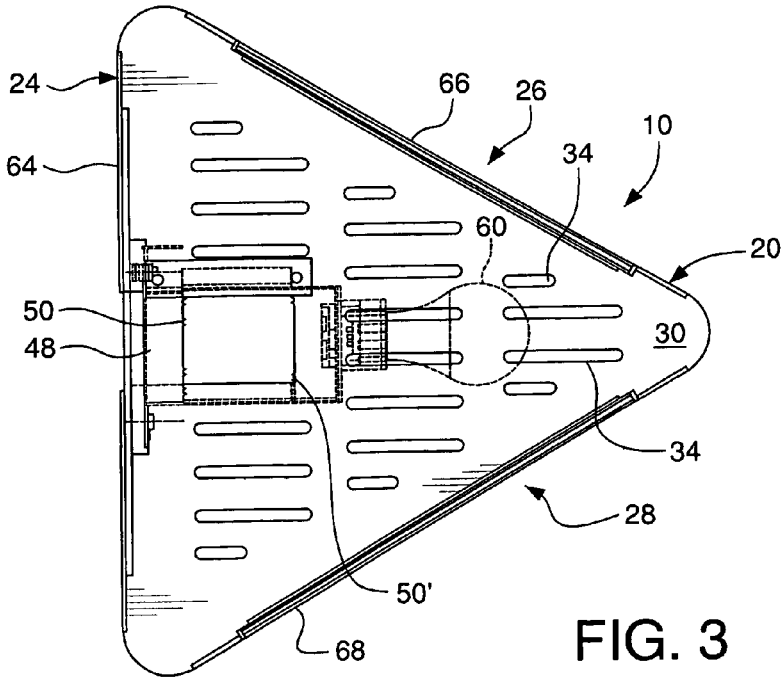
FIG. 3 is a top elevational view of the lighting unit illustrated in FIG. 1.

As best seen in FIGS. 2 and 3, the housing 20 can comprise a substantially polygonal configuration such as a triangular configuration with the first side 24, second side 26, and third side 28 preferably being of equal length and height. The top 30 can be ventilated with a plurality of slots 34 across the surface of the top 30 for promoting air flow through the housing 20. This prevents the housing 20 from overheating by ventilating the heat emitted by a light bulb 60 and wire chamber 56.

The housing 20 can be constructed by a variety of materials, such as low carbon sheet steel, or a composition of metals and plastics. Housing 20 can have any type of finish; it can be painted, galvanized, or include a combination of finishes.

The base 32 of housing 20 is substantially the same size as the top 30. It serves as a support for the sides 24, 26, and 28 and a plurality of channels 40 for receiving a first plaque 64, a second plaque 66, and a third plaque 68. Sides 24, 26, and 28 can be curvilinear at their ends to prevent the housing 20 from having sharp edges at the apices of sides 24, 26, and 28. Further, this adds a smooth-looking finish and a modern design to the housing 20.

As seen in FIG. 5, sides 24, 26, and 28 further comprise a plurality of upwardly opening channels 40 for receiving the bottoms of a first plaque 64, a second plaque 66, and a third plaque 68. Plaques 64, 66, and 68 have planar surfaces that fit securely into the plurality of channels 40. They are translucent enough so that light passes through them. The first plaque 64 fits snugly into channel 40 and covers clamp plates 44, 80. Inwardly opening channels 41 and 43 are formed on the housing 20 for slidably receiving the sides of each of the plaques 64, 66, and 68. They are disposed substantially perpendicular to channels 40 and outside the plane of clamp plates 44, 80 to support the plaques 64, 66, and 68 once the plaques are positioned in the housing 20.

As seen in FIGS. 1 and 5, each of plaques 64, 66, and 68 comprises, on its outwardly facing surface, at least one indicia or numeral, letter, picture, or symbol 42 for identifying the housing 20. This is particularly useful in retail service locations where the housing 20, and more specifically, plaques 64, 66, and 68, identify which checkout counter is operating for customers. By mounting the lighting unit 10 high on a pole 22, such as a pole 22, the lighting unit 10 is easier for customers to see from a distance so they know which location is open for business.

The U-shaped opening or slot 36 is formed in the first side 24 of the housing 20 for defining the receiving location 38. The upper portion of the U-shaped opening 36, that is closest to the clamp plates 44, 80 is a smaller inlet adjacent the first side 24, perpendicular to the slotted recesses 46. The opening 36 has a width of approximately one-sixth the length of the first side 24. Its length is approximately one-third the transverse distance from the first side 24 to the apex of 26, 28. The depth of the opening 36 is as small as possible to contain the pole 22, but large enough so that the bulb 60 is substantially in the center of the unit 10. The receiving location 38 is adjacent the pole 22 when the pole 22 is attached to the housing 20 between the top 30 and the base 32. The depth of each horizontal flange 48, $48^1$ on the clamp plate is approximately one-fourth of the depth of the opening 36 from the edge of the first side 24 to the receiving location 38. The depth of each horizontal flange 51, $51^1$ perpendicular to flanges 48, $48^1$ is approximately one-seventh of the depth of the opening 36 from the edge of the first side 24 to the receiving location 38. A plurality of teeth $50^1$ are attached to the top and base at the receiving location 38 for gripping the pole 22 once the pole 22 is installed.

The clamp plates 44, 80 as illustrated in FIGS. 1, 2, and 4, are secured to the first side 24 of the housing 20, adjacent pole 22 and adjacent the internal surface of the first plaque 64. The purpose of clamp plates 44, 80 is to provide access to the wire chamber 56, a planar covering for the wire chamber 56, and a gripping means for securing the housing 20 to the pole 22.

The first side 24 of the housing 20 comprises a means for securing the clamp plates 44, 80 to the housing 20. The means for securing the main body of the clamp plates 44, 80 can be a plurality of mounting screws 53 engaging a plurality of slotted recesses 46 located towards an edge of the clamp plates 44, 80 at the top of the housing 20 for aligning the clamp plates 44, 80 with the first side 24.

As illustrated in FIGS. 2 and 4, the main body 47 contains two clamp plates 44, 80, each having a planar surface and forming upper and lower plates. The main body 47 is a thin plate, preferably made of bent sheet metal. A second clamp plate 80 is located below a first clamp plate 44, but attached to clamp plate 44 such that they connect at upper and lower edges, the lower edge of clamp plate 44 connects with the upper edge of clamp plate 80. Clamp plates 44, 80 as initially manufactured may be identical to each other in both structure and composition, but are rotated 180° apart from each other. The clamp plates 44, 80 are substantially square so when rotated to fit different pole depths 21, 22, the slotted recesses 46 always align with the mounting screws 52. Clamp plates 44, 80 may include a label (not shown) attached to the surface for identifying the source of manufacture and additional information about the product, such as providing assembly instructions to the end user.

The clamp plates 44, 80 further comprise means for gripping the pole 22. As best illustrated in FIGS. 4 and 5, means for gripping can be a horizontal gripping plate or flange 48, as mentioned previously. The flanges 48 are located at the top 30 and base 32 and substantially perpendicular to the main body 47 of the clamp plates 44, 80. They are received in the housing 20, preferably by an opening or slot 57. There can also be a vertical gripping plate or flange 51 located at the pole 22 and substantially perpendicular to the main body 47, in a plane perpendicular to the flange 48.

The clamp plate 44 may have a plurality of flanges 48, 51, or flanges 48[1], 51[1], of different widths for grasping a wide variety of pole 22 depths or thicknesses. Each clamp plate includes one deep or wide flange and one shallow or narrow flange such that when the clamp plates are rotated 90°, each clamp plate is equipped with one or more flanges suitable for the respective poles.

Breakaway tabs 54 allow the same clamp plate to be used in four different orientations. The horizontal upper flange or first flange 48 and the vertical flange or third flange 51 attached to clamp plate 44 are the same structure as the horizontal lower flange or second flange 48[1] and the vertical flange or fourth flange 51[1] attached to clamp plate 80. When used with the deeper pole 21, such as a 3" pole depth, one breakaway tab 54, 54[1] is removed from each clamp plate because they would prevent clamping if left intact. The remaining tabs 54[1], 54 effectively block access to wire chamber 56 by being reclined in opening 57. When the housing is mounted to a shallower pole 22, such as a 2⅝" pole depth, the breakaway tabs 54, 54[1] are not removed because the flanges with tabs 54, 54[1] are not in use.

Figure 8:
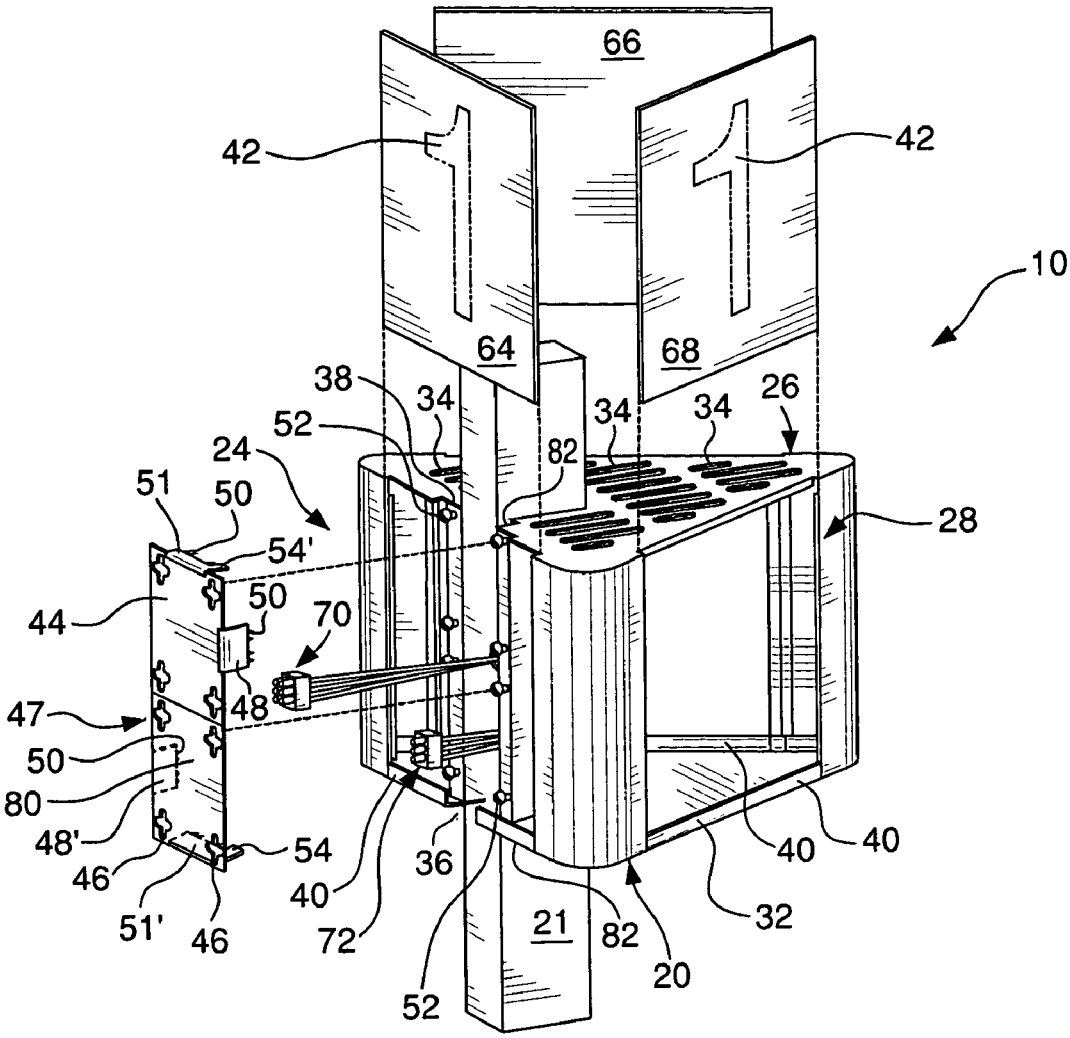
FIG. 8 is an exploded, rear, perspective view of the lighting unit, showing the clamp plates and plaques removed from the housing and the two clamp plates rotated 90° from the clamp plates illustrated in FIG. 1 to grip a vertical member having a larger depth.

The clamp plates 44, 80 releasably engage with the first side 24 and span the opening 36 adjacent the pole 22. Once connected to the housing 20, either the first flange 48 and the second flange 48[1] or the third flange 51 and the fourth flange 51[1] engage the pole 22 with their teeth 50. The depth of the pole controls whether flanges 48, 48[1] or flanges 51, 51[1] engage the pole. When housing 20 is mounted onto a deeper pole 21, as shown in FIG. 8, such as a 3" pole, third flange 51 and fourth flange 51[1] engage the pole 21. They are narrower in width than flanges 48, 48[1] so they grip the deeper pole 21 because the area adjacent the pole 21 in which they are received is less than that required by the shallower pole 22. When housing 20 is mounted onto a shallower pole 22, as shown in FIG. 1, such as a 2⅝" pole, first flange 48 and second flange 48[1] engage the pole 22. Once the appropriately sized flanges engage the pole 21, 22, a plurality of teeth 50, 50[1] penetrate the pole 22 to strengthen the connection between the housing 20 and the pole 22. The flange teeth 50 and the receiving location teeth 50[1] ground both the housing 20 and the clamp plates 44, 80 to the multi-outlet assembly 22. The multi-outlet assembly 22 is grounded to the retail location ground.

The flanges 48, 51 are further defined by teeth 50 for gripping the housing 20 by penetrating the pole 22 and locking the clamp plates 44, 80 in a position that secures the elevated housing 20 to the pole 22. The teeth 50 are typically arranged along the outermost edge of the flanges 48. There are advantageously four sets, while there could be more or less than four sets, of teeth 50, each set advantageously including two, while there could be one or more, individual teeth. Typically, three sets, while there could be more or less than three sets, of teeth 50 will grip the pole 22. It is possible to penetrate the pole 22 with only one tooth 50, 50[1]. The remainder will always be positioned in the housing 20 to cover the wire chamber 56. The teeth 50, 50[1] may include a variety of shapes, including, but not limited to, a saw tooth, a square tooth, or a round tooth.

Recess 82 is formed by opening 57 and pole 21 when housing 20 is attached to the deeper pole 21 because the first side 24 is not flush with the edge of pole 21. The breakaway tabs 54, 54[1] cover this recess 82 to protect the interior of housing 20, specifically, wire chamber 56, and to prevent a gap between the flanges 51, 51[1] and the pole 21.

Each narrow flange 51, 51[1] comprises two breakaway tabs 54, 54[1] when the clamp plates 44, 80 are manufactured. The breakaway tabs 54, 54[1] are weakened or perforated for user-friendly removal. This way, all clamp plates can be made equally or from the same die or mold, thereby keeping the number of parts and stock keeping unit (SKU) numbers to a minimum. Breakaway tab 54 is removed from clamp plate 44 and breakaway tab 54[1] is removed from flange 80. Consequently, when each flange is rotated 90° from the position where the first flange 48 and second flange 48[1] engage the shallow pole 22 (FIG. 1) to the position where the third flange 51 and fourth flange 51[1] engage the deeper pole 21 (FIG. 8), each breakaway tab 54, 54[1] will cover recess 82, thereby blocking access to wire chamber 56.

The first plaque 64 is positioned over the main body 47 of clamp plates 44, 80 and rests in channels 40 disposed at the bottom of the first side 24 to support the first plaque 64 once the plaque 64 is positioned in the housing 20. The first plaque 64 is positioned over the main body 47 to present an aesthetically pleasing view of the lighting unit 10 by blocking visual access to clamp plates 44, 80 and to allow the first side 24 to be a visual indicator that the lighting unit 10 is illuminated. The clamp plates 44, 80 are secured to the lighting unit 10 with mounting screws 52 and slotted recesses 46, as seen in FIGS. 2 and 4. The slotted recesses 46 are designed to receive a mounting screw 52. The mounting screws 52 are received in threaded openings 53 to couple the clamp plates 44, 80 to the first side 24 and fixedly secure them to the housing 20.

Figure 6:
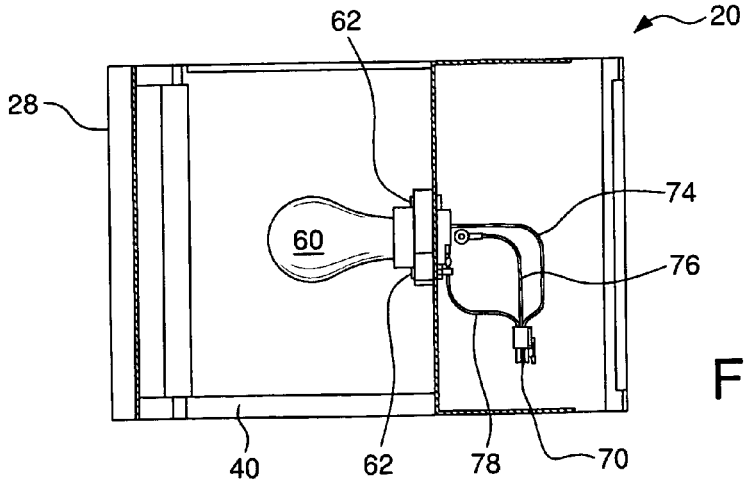
FIG. 6 is a side view of the third side of the lighting unit illustrated in FIG. 1, showing the third plaque removed, thereby uncovering the means for illuminating the housing.
Figure 7:
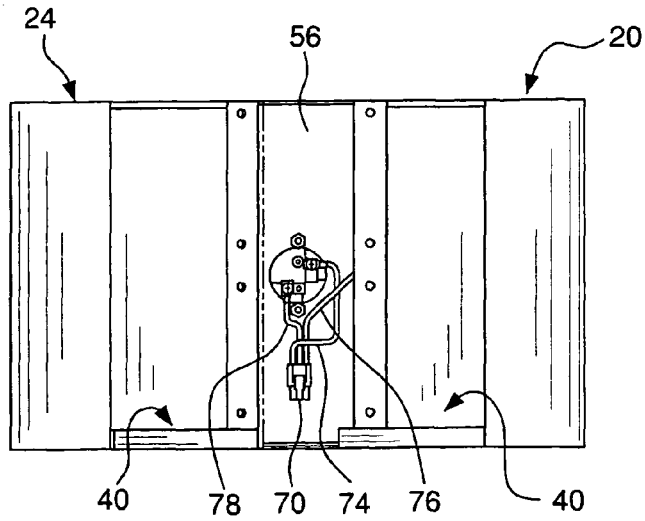
FIG. 7 is a rear view of the first side of the lighting unit illustrated in FIG. 1, showing the wire configuration of the wiring chamber.

A wire chamber 56 is located within the housing 20 for storing a means for illuminating the housing 20. The wire chamber 56 may extend less than the full vertical length of the housing 20. As best seen in FIGS. 6 and 7, the wire chamber 56 encases a plurality of electrical wires 74, 76, and 78 for delivering electrical current to the housing 20. The electrical current travels through a first wire 74, a second wire 76, and a third wire 78 and is transferred within the wire chamber 56 to a light bulb or lamp 60.

The wire chamber 56 comprises a connector 72 that is either a 6-pin connector or a 3-pin connector that further attaches the housing 20 to the pole 22. The 3-pin connector 72 (or the 6-pin connector 72) of the wire chamber 56 is mated to a corresponding 3-pin connector 70 (or 6-pin connector 70) of the pole 22. Once the respective connectors are mated, the 3-pin or 6-pin assembly is pushed into a space along the interior of the housing 20. This prevents the wires 74, 76, and 78 from being crushed under the pressure of tightened clamp plates 44 and 80. Further, the light bulb 60 is threaded to a porcelain receptacle 58 in the wire chamber 56 which is mounted by a plurality of mounting screws 62.

Once connected and turned on, the light bulb 60 illuminates from the interior of the housing 20 through the transparent plaques 64, 66, and 68 such that the entire lighting unit 10 is visible from a distance. The illuminated plaques 64, 66, and 68 indicate to customers in a retail service location that the particular checkout counter where the housing 20 is coupled to the pole 22 is open for business.

Assembly and Operation

Once the lighting unit 10 is manufactured, it is shipped to an installer. Prior to shipping, breakaway tab 54 may be detached from clamp plate 44 and breakaway tab 54[1] may be detached from clamp plate 80. This allows assembly with only the necessary breakaway tabs 54, 54[1] still attached to the main body 47. Preferably, a qualified electrician performs the installation.

Upon delivery, the plaques 64, 66, and 68 are withdrawn from channels 40. Mounting screws 52 are unthreaded from slotted recesses 46 to loosen the clamp plates 44, 80 from side 24. The mounting screws 52 are unthreaded enough to disengage the main body 47 from the lighting unit 10 but not completely removed from the recesses 46 to prevent the screws 52 from being lost.

By rotating the mounting screws 53 outwardly, the clamp plates 44, 80 are disengaged from the pole 22, the housing 20 can be vertically adjusted relative to the pole, and the mounting screws 53 can be re-tightened to in turn re-engage the clamp plates with the pole to fixedly position the housing relative to the pole in the new desired vertical location.

Housing 20 is positioned onto pole 22 or pole 21 at the desired height and centered vertically at the opening 36 and adjacent to a 3-pin connector or a 6-pin connector. Teeth 50[1] attached to the top and base at the receiving location 38 penetrate the pole 22. Depending on which connector the pole 22 is equipped with will determine whether to attach the corresponding 3-pin connector 70 or 6-pin connector 72 of housing 20. Additional sized pin connectors could be attached if the vertical member includes the same. Once attached, the main body 47 is reattached to the first side 24 and the mounting screws 52 are tightened into the recesses enough to secure clamp plates 44, 80, but not over-tightened.

The orientation of clamp plates 44, 80 is dependent on the depth of the pole. For a shallow pole 22, as seen in FIG. 1, first flange 48 and second flange 48[1] engage the upper section and bottom section of the pole 22, respectively. When the housing 20 is installed onto a deeper or wider pole 21, the clamp plates 44, 80 are each rotated 90° to allow the narrower flanges 51, 51[1] to engage the deeper pole 21. This way, the breakaway tabs 54, 54[1] span the recess 82 formed when the deeper pole 21 is used. Once main body 47 is attached, teeth 50 penetrate and securely grip the pole 22.

Once clamp plate 44 is secured, the pin connector 70 and the corresponding 3-pin connector from the pole 22 are hidden in the housing 20 and pushed into a space to mask the wires from outside the unit 10. The mounting screws 52 coupled to clamp plate 80 are then tightened once the correct flange length is selected and the clamp plate 80 is rotated 90°, as necessary. After the electrician confirms the lighting unit 10 is correctly and safely attached to the pole 22, a light bulb 60 is threaded to a porcelain receptacle 58 and plaques 64, 66, 68 are slid into channels 40. Flange 51 engages the upper section of pole 21 and fourth flange 51[1] engages the lower section of pole 21, as seen in FIG. 8.

While a particular embodiment has been chosen to illustrate the invention, it will be understood by those skilled in the art that various changes and modifications can be made therein without departing from the scope of the invention as defined in the appended claims.

What is claimed is:

1. A lighting unit adapted to be mounted to a vertical member, the lighting unit comprising:

a substantially polygonal housing secured to the vertical member and including at least a first side, a second side, and a third side, and a top and a base;

said first side, said second side, and said third side further comprising a plurality of channels for receiving a first plaque, a second plaque, and a third plaque;

an opening formed in said first side of said housing, and defining a receiving location for the vertical member between said top and said base of said housing; and at least one clamp plate releasably engageable with said first side, receivable in said opening adjacent said vertical member and engageable with the vertical member and including at least one breakaway tab for blocking access to a wire chamber located within said housing for receiving means for illuminating said housing.

2. A lighting unit according to claim 1, wherein the vertical member is a pole.

3. A lighting unit according to claim 1, wherein the vertical member is a multi-outlet assembly.

4. A lighting unit according to claim 1, wherein each of said plaques comprises at least one of a number, letter, symbol, or picture displayed on an outwardly facing surface of each of said plaques for identifying said housing.

5. A lighting unit according to claim 1, wherein said first side includes at least two recesses vertically disposed outside a plane of said clamp plate to receive said clamp plate.

6. A lighting unit according to claim 1, wherein said first plaque is positioned over said clamp plate to block visual access to said clamp plate.

7. A lighting unit according to claim 1, wherein a first inwardly opening channel and a second inwardly opening channel are disposed substantially perpendicular to said plurality of channels and outside a plane of said clamp plate to support said plaques once said plaques are positioned in said housing.

8. A lighting unit according to claim 1, wherein said top includes a plurality of slots for ventilating air through said housing.

9. A lighting unit according to claim 1, wherein said first side includes means for securing said clamp plate to the housing.

10. A lighting unit according to claim 9, wherein said means for securing said clamp plate is a plurality of mounting screws.

11. A lighting unit according to claim 10, wherein said clamp plate further comprises a plurality of slotted recesses for receiving said plurality of mounting screws.

12. A lighting unit according to claim 1, wherein said clamp plate further comprises means for gripping the vertical member.

13. A lighting unit according to claim 12, wherein said means for gripping includes at least one flange.

14. A lighting unit according to claim 13, wherein said flange includes at least one tooth for penetrating the vertical member and said tooth locks said clamp plate to the vertical member.

15. A lighting unit according to claim 1, wherein said receiving location further includes a plurality of teeth for penetrating the vertical member and said teeth lock said housing to the vertical member.

16. A lighting unit according to claim 1, wherein said wire chamber further comprises a plurality of electrical wires.

17. A lighting unit according to claim 1, wherein said wire chamber includes a porcelain receptacle threaded to receive a lamp.

18. A lighting unit adapted to be mounted to a vertical member, the lighting unit comprising:

a substantially polygonal housing secured to the vertical member and including at least a first side, a second side, and a third side, and a top and a base;

said first side, said second side, and said third side further comprising a plurality of channels for receiving a first plaque, a second plaque, and a third plaque;

an opening formed in said first side of said housing, and defining a receiving location for the vertical member between said top and said base of said housing;

at least one clamp plate releasably engageable with said first side, receivable in said opening adjacent said vertical member and engageable with the vertical member, said clamp plate includes a main body and a horizontal flange located at the top and substantially perpendicular to said main body;

a wire chamber located within said housing for receiving means for illuminating said housing; and a vertical flange located at the side of the vertical member and substantially perpendicular to said main body.

19. A lighting unit according to claim 18, wherein said clamp plate includes at least one flange received in a recess in said housing.

20. A lighting unit according to claim 19, wherein said flange includes at least one tooth.

21. A lighting unit according to claim 18, wherein said main body is a thin plate.

22. A lighting unit according to claim 21, wherein said thin plate is composed of bent sheet metal.

23. A lighting unit adapted to be mounted to a vertical member, the lighting unit comprising:

a substantially polygonal housing secured to the vertical member and including at least a first side, a second side, and a third side, and a top and a base;

said first side, said second side, and said third side further comprising a plurality of channels for receiving a first plaque, a second plaque, and a third plaque;

an opening formed in said first side of said housing, and defining a receiving location for the vertical member between said top and said base of said housing;

at least one clamp plate releasably engageable with said first side, receivable in said opening adjacent said vertical member and engageable with the vertical member and including a means for gripping the vertical member, said vertical member having at least one flange, wherein said flange includes a plurality of teeth located at the ends of said flange and arranged in at least three sets, each set including at least two teeth; and a wire chamber located within said housing for receiving means for illuminating said housing.

24. A lighting unit according to claim 23, wherein said clamp plate includes a main body and an upper gripping flange extending substantially perpendicular to said main body.

25. A lighting unit according to claim 24, wherein said clamp plate includes a lower gripping flange extending substantially perpendicular to said main body.

26. A lighting unit adapted to be mounted to a vertical member, the lighting unit comprising:

a housing secured to the vertical member wherein the vertical member is a pole, said housing including a first side, a second side, a third side, a top having a plurality of slots and a base, wherein said first side, said second side, and said third side each comprises a plurality of channels for receiving a first plaque, a second plaque, and a third plaque;

an opening formed in said first side, said opening defining a receiving location for said pole between said top and said base;

a main body having at least one clamp plate releasably engageable with said first side, said main body being receivable in said opening adjacent to said vertical member, wherein said main body further includes a plurality of flanges for gripping said pole, said flanges including a plurality of teeth for penetrating said pole; and a wire chamber located within said housing for receiving means for illuminating said housing, said wire chamber including a plurality of electrical wires connected to a lamp.

27. A lighting unit adapted to be mounted to a pole, the lighting unit comprising:

a housing secured to said pole, said housing including a first side, a second side, and a third side, a top having a plurality of ventilation slots, and a base, wherein said first side, said second side, and said third side each comprises a plurality of channels for receiving a first plaque, a second plaque, and a third plaque;

an opening formed in said first side defining a receiving location for said pole between said top and said base, said receiving location having a plurality of teeth for gripping said pole;

a main body having at least one clamp plate releasably engageable with said first side, and being received in said opening adjacent to said vertical member, wherein said at least one clamp plate includes a horizontal gripping flange for penetrating said pole, said flange including a plurality of teeth for gripping said pole; and a wire chamber located within said housing for receiving means for illuminating said housing.

28. A lighting unit according to claim 27, wherein said main body further includes a second horizontal gripping flange for penetrating said pole.

29. A lighting unit according to claim 27, wherein said opening extends into said housing substantially one-third the transverse depth of said housing.

30. A lighting unit according to claim 27, wherein said horizontal gripping flange extends into said opening at least one-seventh the transverse depth of said opening.

31. A lighting unit adapted to be mounted to a vertical member, the lighting unit comprising:

a substantially polygonal housing securable to a vertical member and including at least a first side, a second side, and a third side, and a top and a base;

an opening formed in said first side of said housing, and defining a receiving location for a vertical member between said top and said base of said housing; and a first clamp plate releasably engageable with said first side, receivable in said opening adjacent the vertical member and engageable with a vertical member, said first clamp plate including an upper edge having a first flange extending therefrom with a first width, a first side edge having a second flange extending therefrom with a second width less than the first width, and a lower edge, said first clamp plate engaging said housing in a first position to engage a vertical member by said first flange having a first depth, and a second position to engage a different-sized vertical member by said second flange, the different-sized vertical member having a second depth larger than the first depth.

32. A lighting unit according to claim 31, and further including a second clamp plate releasably engageable with said first side adjacent said first clamp plate and further including a third flange of said first width at a bottom edge and a fourth flange of said second width at a second side edge, said second clamp plate engaging said housing in a first position to engage a vertical member by said third flange having a first depth, and a second position to engage the different-sized vertical member by said fourth flange, the different-sized vertical member having a second depth larger than the first depth.

33. A lighting unit according to claim 32, wherein said flanges of the second width include first and second breakaway tabs.

34. A lighting unit according to claim 32, wherein said first and second clamp plates are substantially identical when initially constructed.

35. A lighting unit according to claim 32, wherein said first and second positions are 90° apart.

* * * * *